United States Patent [19]

Wheeler

[11] Patent Number: 4,972,563

[45] Date of Patent: Nov. 27, 1990

[54] YARN TEXTURING MACHINE

[75] Inventor: Martin J. Wheeler, Heald Green, United Kingdom

[73] Assignee: Rieter Scragg Limited, Cheshire, United Kingdom

[21] Appl. No.: 350,693

[22] Filed: May 9, 1989

[30] Foreign Application Priority Data

May 19, 1988 [GB] United Kingdom ..... 8811842
May 19, 1988 [GB] United Kingdom ..... 8811842

[51] Int. Cl.[5] ..... D02J 1/08; D02G 1/16

[52] U.S. Cl. ..... 28/220; 28/271; 57/291

[58] Field of Search ..... 28/220, 271, 272; 57/245, 263, 290, 291, 334, 339; 242/35.5 R

[56] References Cited

U.S. PATENT DOCUMENTS

| | | | |
|---|---|---|---|
| 3,041,813 | 7/1962 | Enneking | 57/290 |
| 3,879,926 | 4/1975 | Bartling et al. | 57/263 X |
| 3,897,911 | 8/1975 | Morton | 242/35.5 R |
| 3,916,609 | 11/1975 | Yamada et al. | 57/291 |
| 3,965,662 | 6/1976 | Spurgeon | 57/339 |
| 3,971,108 | 7/1976 | Gorrafa | 28/272 |
| 4,170,867 | 10/1979 | Leininger | 57/245 |
| 4,222,223 | 9/1980 | Nelson | 28/271 X |
| 4,253,299 | 3/1981 | Borenstein et al. | 28/220 |
| 4,430,852 | 2/1984 | Hatcher | 28/220 X |
| 4,719,771 | 1/1988 | Brough et al. | 68/200 |
| 4,726,180 | 2/1988 | Naylor et al. | 57/334 |

FOREIGN PATENT DOCUMENTS 0037118 10/1981 European Pat. Off. .

*Primary Examiner*—Werner H. Schroeder
*Assistant Examiner*—Bradley Kurtz DeSandro
*Attorney, Agent, or Firm*—Oblon, Spivak, McClelland, Maier & Neustadt

[57] ABSTRACT

A yarn texturing machine having an air jet for combining and texturing at least two yarns to form a single textured yarn, which includes respective yarn feed and drawing devices for each yarn. To provide good control of the yarns in the low tension region upstream of the jet the drawing devices are positioned relative to the jet and each other so that the yarns travelling to the jet travel along straight, spaced yarn paths which converge at the jet at an angle of between 70° and 50°, and lie in a plane inclined at between 60° and 90° to the axis of the jet. After the jet the textured yarn is passed upwardly then downwardly over a setting heater located above the jet and then to a wind-up mechanism disposed beneath the jet.

20 Claims, 3 Drawing Sheets

YARN TEXTURING MACHINE

BACKGROUND OF THE INVENTION

1. Field of the Invention

This invention relates to yarn texturing machines, and in particular to textile machines for the texturing of yarns by means of fluid jets.

2. Discussion of the Background

Textile machines are known in which one or more yarns are fed in single, parallel or core/effect form to a fluid jet in which the turbulent fluid serves to cause the filaments of the yarns to form loops, thereby producing a bulky single or composite yarn suitable for various textile applications. To facilitate this process a yarn wetting device may be located immediately upstream of the fluid jet, acting on some or all of the yarns, and in such cases the yarn wetting device and the fluid jet are customarily housed in a common housing or "jet-box". With parallel and, more especially, core/effect arrangements, in order to ensure acceptable texturing of the yarn, it is necessary that any yarn which runs through the wetting device is kept apart from the other yarn or yarns until they come together in the fluid jet itself. If this is not done, entanglement of the filaments of the yarns can take place upstream of the fluid jet, and this prevents or inhibits the texturing of the yarn. To prevent such prior entanglement it is usual to have guides for the two yarns at the entry of the jet-box and also on the body of the jet itself. These guides, whilst keeping the paths of the yarns separate, also provide changes in direction of travel of the yarns, with consequential increases in yarn tension as a yarn travels around a guide. Hence the yarn tensions prior to entry to the jet box may be considerably less than those at entry to the jet itself. Since the tensioning effect of the fluid jet is reduced as the yarn throughput speed increases an upper limit of yarn throughput speed occurs when the yarn tensions upstream of the jet box input guides fall to a level at which threadline instability occurs. To avoid such a problem it is known to feed the two yarns in spaced but converging straight yarn paths from the feed means to the air jet, for example in U.S. Pat. No. 4608814. Such an arrangement eliminates the change in yarn tension along the yarn path. In this prior patent the angular separation of the yarns is specified as being preferably in the range of 8° to 25°. However, at current high processing speeds the yarn tensions upstream of the air jet are low and it has been found that the abovementioned entanglement of the yarns can occur with such an arrangement. It has also been found that too large an angular separation of the converging yarns leads to deterioration in the quality of the resulting textured yarn.

SUMMARY OF THE INVENTION

It is an object of the present invention to provide a yarn texturing machine which avoids, at least to a substantial extent, the abovementioned disadvantages, and which ensures adequate control of the yarn throughout its passage through the machine.

The invention provides a yarn texturing machine comprising a fluid jet texturing means for a plurality of yarns to form a textured yarn and respective feed means for each of said yarns, whereby each of said feed means is disposed in said machine relative to the other feed means and said fluid jet texturing means so as to feed the respective yarn along a substantially straight yarn path from said feed means to said fluid jet texturing means, which yarn path is spaced from the path of the other yarn or yarns but converges therewith within said fluid jet texturing means at an angle of between 70° and 50° with respect to each other. Said paths may converge at an angle of substantially 65°. The plane containing said yarn paths may be inclined to the axis of said jet at an angle of between 60° and 90°, preferably at substantially 70°.

Each of said feed means may comprise a pair of feed rollers providing a nip therebetween through which the respective yarn may travel. One roller of each of said pairs of feed rollers may be rotatably driven. For each of said yarns said machine may comprise respective first feed means operable to forward said yarn to said respective feed means at a speed less than that at which said yarn is fed to said fluid jet texturing means, whereby said yarn is drawn between said first feed means and said respective, drawing, feed means. Each of said first feed means may comprise a pair of first feed rollers providing a nip therebetween through which the respective yarn may travel. One roller of each of said pairs of first feed rollers may be driven in rotation.

Heating means for each of said yarns may be provided between the respective first feed means and the respective drawing feed means, and said heating means may comprise a plate, pin or roller. A common heating means may be provided for said plurality of yarns, and said heating means may be electrical heating means or may be vapor phase heating means.

Said machine may comprise a creel, whereby said first feed means are operable to withdraw said yarns from respective supplies thereof mounted in said creel. Said machine may comprise a main frame spaced from said creel and on which said fluid jet texturing means, said drawing feed means and said first feed means are mounted, said first feed means withdrawing said yarns from said supplies thereof along feed paths extending above an operator's aisle disposed between said creel and said main frame.

The machine may also comprise yarn wetting means which may be disposed adjacent but upstream of said fluid jet texturing means. Said wetting means may comprise means adapted to apply water to at least one of said yarns, in which case said wetting means may be disposed so as to apply water to a yarn forming a core yarn of said textured yarn.

Said machine may comprise wind-up means, which may be mounted in said main frame beneath said fluid jet texturing means. Said feed means and said wind up means may be driven by respective drive shafts extending longitudinally of said machine. Said machine may also comprise further treatment means, such as heating means, which may comprise an elongate contact heater mounted on said main frame above said fluid jet texturing means to extend upwardly therefrom. Said further treatment heating means may also comprise turnround yarn guide means around which said textured yarn may pass between an upwards and a downwards passage over said heating means. Said turnround guide means may be mounted on said further treatment heater to be movable longitudinally thereof between a threading location at the lower end of said further treatment heater and an operating location at the upper end of said further treatment heater. Said turnround guide means may be mounted on a sledge. Said further treatment heating means may comprise a heater plate having a pair of substantially parallel grooves therein extending from said lower end to said upper end of said heater.

BRIEF DESCRIPTION OF THE DRAWINGS

The invention will now be further described with reference to the accompanying drawings in which.

DESCRIPTION OF THE PREFERRED EMBODIMENT

Figure 1:
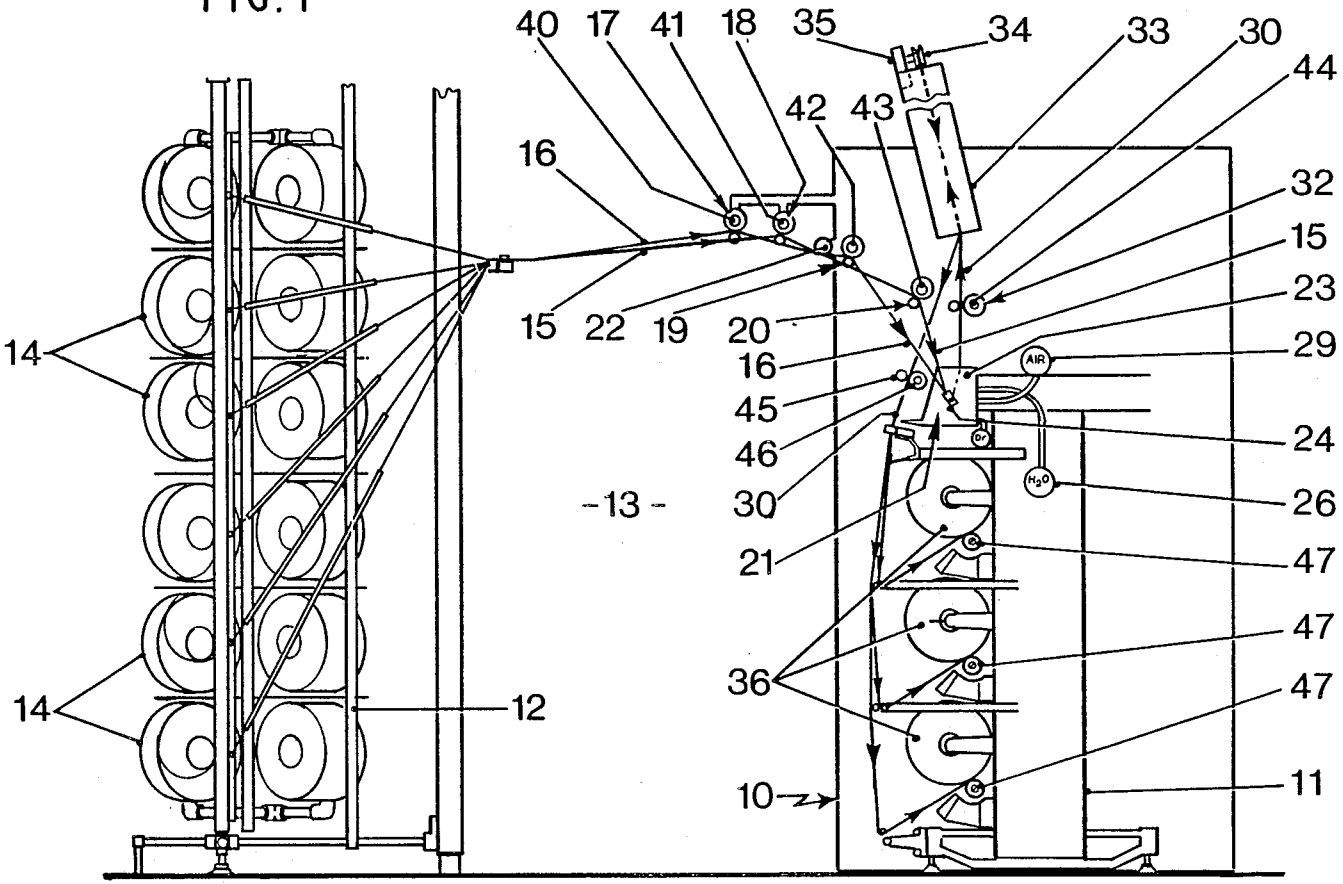
FIG. 1 is a threadline diagram of a machine in accordance with the invention

Referring now to the figures, there is shown in FIG. 1 a yarn texturing machine 10 comprising a main frame 11 and a creel 12 which are separated from each other by an operator's aisle 13. In the creel 12 are supplies 14 of two yarns 15, 16 (e.g., core and effect yarns). The yarns 15, 16 are withdrawn from their supply bobbins 14 by their respective first feed means 17, 18 which are mounted on the main frame 11 on respective drive shafts 40, 41 so that the yarns 15, 16 in travelling from the creel 12 to the first feed means 17, 18 pass above the operator's aisle 13. Also mounted on the main frame 11 on respective drive shafts 42, 43 are drawing feed means 19, 20 operative to feed the yarn 15, 16 respectively to a texturing section 21. Each of the feed means 17, 18, 19, 20 comprises a driven roller driven by the respective drive shaft 40, 41, 42, 43 and a freely rotatable roller forming a nip therewith through which the yarn 15 or 16 passes. The driven rollers of feed means 19, 20 are driven so as to have a greater peripheral speed than the driven rollers of the first feed means 17, 18 whereby the yarns 15, 16 are drawn between the two sets of feed means 17, 18, 19, 20. To facilitate such drawing a draw pin or roller 22 is mounted on the main frame 11 between the first feed means 17, 18 and the drawing feed means 19, 20. In the case of polyamide yarns being processed, the draw pin or roller 22 may be unheated, but in the case of yarns of polyester, polypropylene, polyvinyl, or the like being processed, the draw pin or roller 22 may be heated. Such heating may be by any known means such as electrical heating or vapor phase heating.

Figure 2:
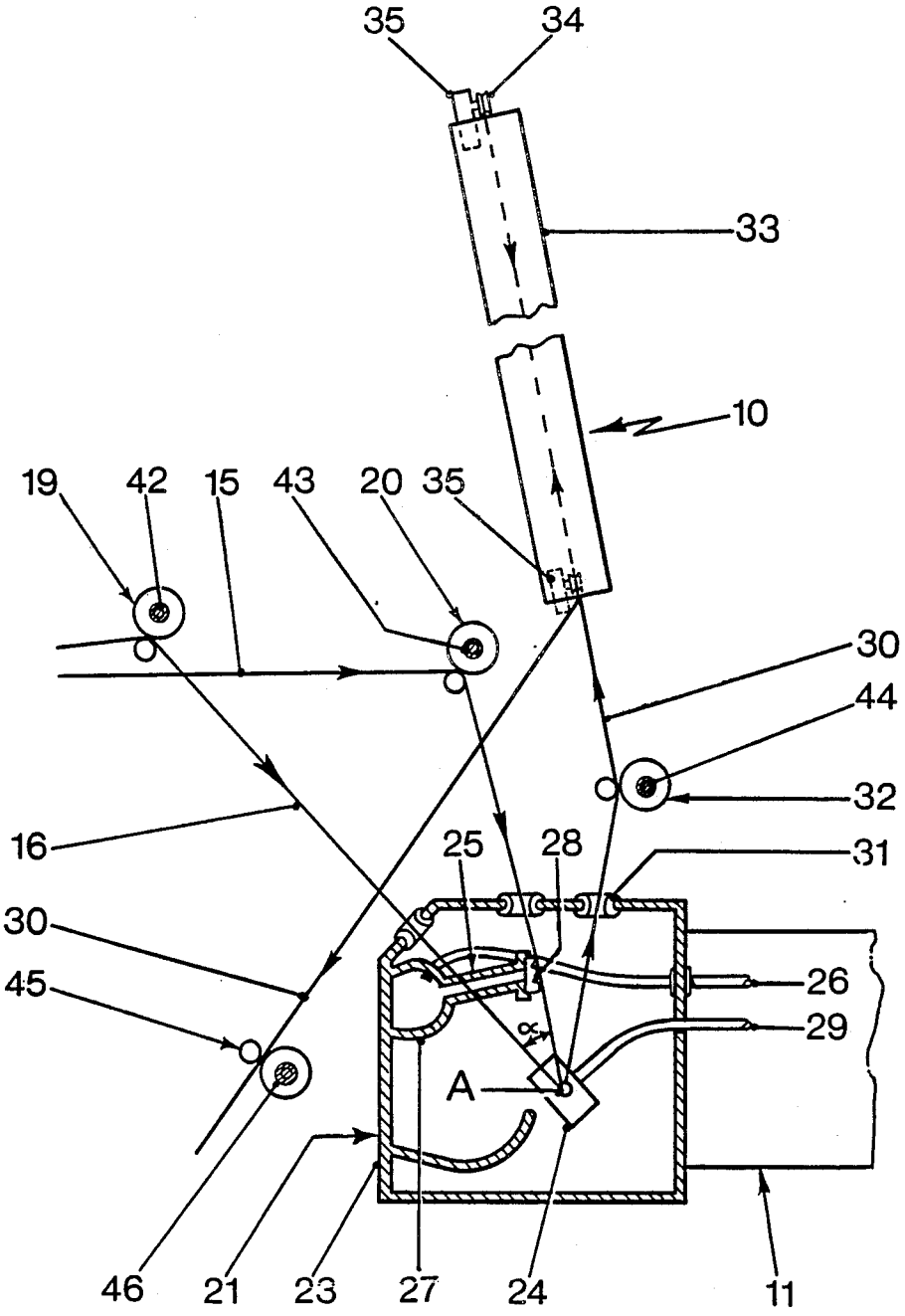
FIG. 2 is a sectional view of part of the machine of FIG. 1 to an enlarged scale.
Figure 3:
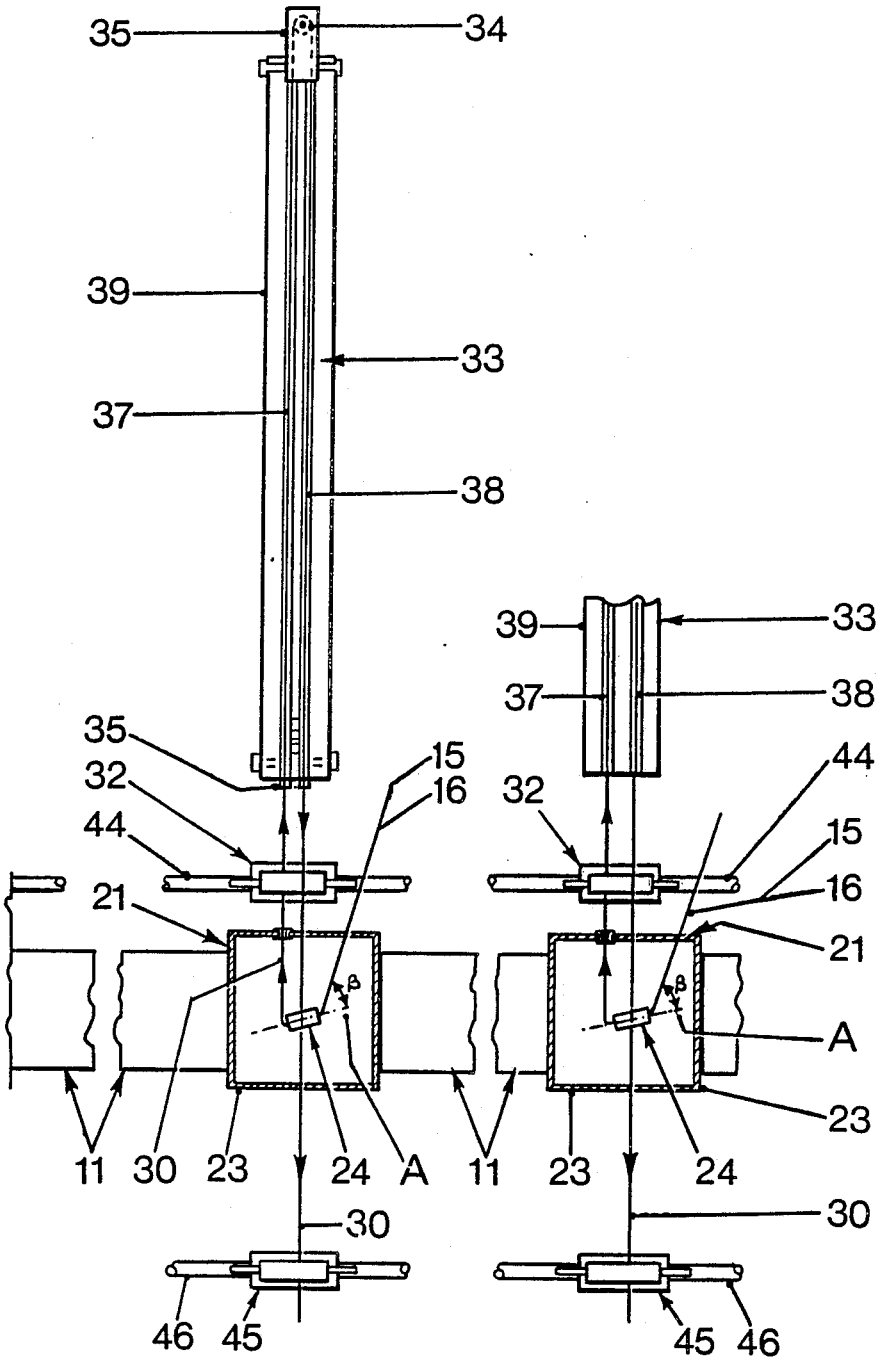
FIG. 3 is a front view of the part of the machine of FIG. 2.

The texturing section 21 is shown in greater detail in FIGS. 2 and 3, and comprises a "box" or housing 23 which is mounted on the main frame 11 and in which is mounted a fluid jet 24 such as an air jet. The relative disposition of the drawing feed means 19, 20 and the fluid jet 24 is such that the yarns 15, 16 are fed from the former to the latter along spaced respective, substantially straight paths, which converge with each other within the fluid jet 24, the plane of the yarn paths being inclined to the axis A of the fluid jet 24 at an angle $\beta$ of between 60° and 90°, preferably substantially 70°, as shown in FIG. 3. Preferably the yarn paths converge at an angle $\alpha$ of between 70° and 50°, for example substantially 65°, as shown in FIG. 2, thereby ensuring optimum control of the yarns in this low tension region and good quality of textured yarn at completion of texturing. Between the drawing feed rollers 19, 20 and the fluid jet 24 is wetting means 25. The wetting means 25 is preferably of the type described in U.S. Pat. No. 4,719,771 which applies liquid to the core or wetted yarn 15, without it deviating substantially from a straight yarn path from the drawing feed means 20 to the fluid jet 24. In this particular case water from a supply 26 thereof is fed to a manifold 27 and then to the applicator head 28. The wetted yarn 15, and the yarn 16 are fed into the fluid jet 24, to which air or other fluid from a supply 29 thereof is also fed. In the fluid jet 24 the yarns 15, 16 are textured and combined to form a single textured yarn 30 which issues from the fluid jet 24 and is guided through a guide: 31, upwardly out of the box or housing 23. Third feed means 32 driven by drive shaft 44 forwards the textured yarn 30 from the fluid jet 24 to a further treatment or setting heater 33 which extends upwardly above the texturing section 21. The third feed means 32 also comprises a roller driven by drive shaft 44 and a freely rotatable roller forming a nip therewith through which the yarn 30 may pass. The driven roller of the of the third feed means 32 may be driven so as to have a peripheral speed less than that of the driven rollers of the drawing feed means 19, 20 so that the yarns 15, 16 are overfed into the texturing section 21 if desired. The textured yarn 30 passes around a "turnround" guide 34 mounted on a sledge 35 which is itself mounted on the heater 33 so as to be movable longitudinally thereof between a threading position at the lower end of heater 33 (shown in dashed lines in FIG. 2) and an operating position at the upper end of the heater 33 (shown in full lines in FIGS. 1 and 2). With the sledge 35 in the operation position, the yarn 30 makes an upward and then a downward passage over the further treatment heater 33, passing in contact therewith along a groove 37 on its upward journey and groove 38 on its downward journey. The grooves 37, 38 are substantially parallel and extend from the lower end of the heater plate 39 of heater 33 to the upper end thereof. From the lower end of heater 33, the yarn 30 is fed downwardly by fourth feed means 45 to wind up means 36 mounted on the main frame 11 in three rows, one above the other beneath the texturing section 21. The fourth feed means 45 and the wind-up means 36 are driven by respective drive shafts 46, 47 extending longitudinally of the machine 10.

Other embodiments of the texturing machine in accordance with the invention will be readily apparent to persons skilled in the art. For example wetting means 25 for both yarns may be provided and the wetting means 25 may be disposed outside of the housing 23. However, it is preferred that the housing 23 is provided around the fluid jet 24 to contain spray issuing therefrom due to the action of the fluid jet on the wet yarn. Also, if preferred, the textured yarn 30 may be drawn from the housing 23 in a downward direction to a further treatment heater 33 disposed in the main frame 11 beneath the texturing section 21 and behind the wind-up means 36, although such an arrangement may limit the length of the heater 33 and therefore the amount of further treatment received by the yarn 30. The provision of separate first feed means and drawing feed means for the two yarns 15, 16 enables different draw ratios to be applied to the two yarns and different feed rates to the texturing section 21. As an alternative to the embodiment shown, separate draw pins or rollers 22 may be provided if desired, particularly if the drawing temperature for the two yarns is to be different. However as a further alternative the yarns 15, 16 may pass around differing diameter parts of the same feed roller for the purpose of providing differing feed speeds and/or draw ratios. Also the relative position of the fluid jet 24 and the drawing feed means 19, 20 may be adjustable so as to vary the angle of convergence of the two yarns 15, 16 if desired.

Any one or each of the feed means 17, 18, 19, 20, 32, 45 may be replaced by a roller / apron, double apron or capstan feed device if desired, each driven by a respective drive shaft extending longitudinally of the machine and common to the appropriate feed means of all the yarn processing stations. The further treatment heaters 33 for each yarn processing station, shown separately in FIG. 3, may be connected as part of a multi-station heater, for example by means of an elongate boiler extending longitudinally of the machine 10 of a vapor phase heater.

In order that the yarn contacting parts of the jet have a usefully long working life whilst being subjected to the abrading action of the yarn, the jet 24, or at least such yarn contacting parts thereof, are of a ceramic material. The use of such a material enables the yarns 15, 16 to enter the jet 24 under tension at the angle of between 60° and 90° to the axis A of the jet 24 without undue wear on the entry part of the jet 24.

We claim:

1. A yarn texturing machine which comprises:

fluid jet texturing means for a plurality of yarns to form a textured yarn, and respective feed means for each of said yarns, whereby each of said feed means is disposed in said machine relative to the other feed means and said fluid jet texturing means so as to feed the respective yarn along a substantially straight yarn path from said feed means to said fluid jet texturing means, which yarn path is spaced from the path of the other yarn or yarns but converges therewith within said fluid jet texturing means at an angle of between 70° and 50° with respect to each other.

2. A machine according to claim 1 wherein said yarn paths converge at an angle of substantially 65°.

3. A machine according to claim 1 wherein said jet has an axis and a plane containing said yarn paths is inclined to said axis at an angle of between 60° and 90°.

4. A machine according to claim 3 wherein said plane is inclined to said axis at substantially a 70°angle.

5. A machine according to claim 1 which comprises feed roller drive shafts extending longitudinally of said machine wherein each feed means comprises a pair of feed rollers providing a nip therebetween through which a respective yarn may travel, and wherein one roller of each of said pairs of feed rollers is driven in rotation by a respective one of said feed roller drive shafts.

6. A machine according to claim 1 which comprises, for each of said yarns, respective first feed means operable to forward said yarn to said respective feed means at a speed less than that at which said yarn is fed to fluid jet texturing means, whereby said yarn is drawn between said first feed means and said respective, drawing, feed means.

7. A machine according to claim 6 which comprises feed roller drive shafts extending longitudinally of said machine, wherein each first feed means comprises a pair of first feed rollers providing a nip therebetween, and wherein one roller of each of said pairs of first feed rollers is driven in rotation by a respective one of said feed roller drive shafts.

8. A machine according to claim 6 which comprises heating means for each of said yarns between the respective first feed means and the respective drawing feed means.

9. A machine according to claim 8 wherein a common heating means is provided for said plurality of yarns.

10. A machine according to claim 6 comprising a creel and a main frame spaced from said creel to define an operator's aisle therebetween, and on which main frame said fluid jet texturing means, said drawing feed means and said first feed means are mounted, said first feed means withdrawing said yarns from supplies thereof mounted in said creel along feed paths extending above said operator's aisle.

11. A machine according to claim 1 which comprises yarn wetting means disposed adjacent but upstream of said fluid jet texturing means.

12. A machine according to claim 11 wherein at least one of said yarns forms a core of said textured yarn, and said wetting means includes means for applying water to said at least one yarn.

13. A machine according to claim 1 which comprises a main frame and wind-up means for said textured yarn mounted in said main frame beneath said fluid jet texturing means.

14. A machine according to claim 13 which comprises wind-up means drive shafts extending longitudinally of said machine wherein said wind-up means are driven by respective ones of said wind-up means drive shafts.

15. A machine according to claim 1 which comprises further feed means operable to feed said textured yarn from said fluid jet texturing means to said wind-up means, and further to treatment means operable to treat said textured yarn between said further feed means and said wind-up means.

16. A machine according to claim 15 which comprises a main frame, wherein said further treatment means comprises an elongate contact heater mounted on said main frame above said fluid jet texturing means to extend upwardly therefrom.

17. A machine according to claim 16 wherein said elongate heater comprises a heater plate having upper and lower ends and having a pair of substantially parallel grooves therein extending from said lower end to said upper end.

18. A machine according to claim 17 wherein said further treatment means comprises a turnround guide around which said textured yarn may pass between an upwards and a downwards passage over said elongate heater.

19. A machine according to claim 18 wherein said turnround guide means is mounted on said elongate heater to be movable longitudinally thereof between a threading location at said lower end of said heater and an operating location at said upper end thereof.

20. A machine according to claim 1 wherein said fluid jet texturing means comprises yarn contacting parts and said parts at least are of a ceramic material.

* * * * *

UNITED STATES PATENT AND TRADEMARK OFFICE

CERTIFICATE OF CORRECTION

PATENT NO. : 4,972,563

DATED : November 27, 1990

INVENTOR(S) : Martin J. Wheeler

It is certified that error appears in the above-identified patent and that said Letters Patent is hereby corrected as shown below:

Title page:

The 2nd Foreign Application Priority Data is incorrect, should be, --May 19, 1988 [GB] United Kingdom.....8811843--.

Signed and Sealed this

First Day of September, 1992

*Attest:*

*Attesting Officer*

DOUGLAS B. COMER

*Acting Commissioner of Patents and Trademarks*